US008203419B2

(12) United States Patent
Nazarian et al.

(10) Patent No.: US 8,203,419 B2
(45) Date of Patent: Jun. 19, 2012

(54) INDUCTOR

(75) Inventors: Alexé Levan Nazarian, Eindhoven (NL); Lukas Frederik Tiemeijer, Eindhoven (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 12/973,848

(22) Filed: Dec. 20, 2010

(65) Prior Publication Data

US 2011/0148558 A1 Jun. 23, 2011

(30) Foreign Application Priority Data

Dec. 21, 2009 (EP) ..... 09180111

(51) Int. Cl.
*H01F 5/00* (2006.01)

(52) U.S. Cl. ..... 336/200
(58) Field of Classification Search ..... 336/65, 336/200, 206–208, 232; 257/531
See application file for complete search history.

(56) References Cited

U.S. PATENT DOCUMENTS 6,922,128 B2 * 7/2005 Vilander et al. ..... 336/200
7,420,452 B1 9/2008 Lee et al.

OTHER PUBLICATIONS

Gianesello F., et al. "3D Group-Cross Symmetrical Inductor: A New Inductor Architecture with Higher Self-Resonance Frequency and Q Factor Dedicated to Advanced HR SOI CMOS Technology," IEEE Radio Frequency Integrated Circuits Symposium, pp. 457-460 (Jun. 17, 2008).
Extended European Search Report for European Patent Appln. No. 09180111.8 (Jun. 1, 2010).

* cited by examiner

*Primary Examiner* — Tuyen Nguyen

(57) ABSTRACT

An inductor includes a conductive track forming at least three inductor turns. The conductive track has a plurality of track sections. The inductor also includes at least two groups of crossing points, each crossing point comprising a location at which the conductive track crosses over itself. The crossing points of each group collectively reverse the order of at least some of the track sections in the inductor, such that inner track sections of the conductive track cross over to become respective outer track sections, and such that outer track sections of the conductive track cross over to become respective inner track sections.

16 Claims, 7 Drawing Sheets

INDUCTOR

This application claims the priority under 35 U.S.C. §119 of European patent application no. 09180111.8, filed on Dec. 21, 2009, the contents of which are incorporated by reference herein.

BACKGROUND OF THE INVENTION

This invention relates to an inductor.

It is well known to provide spiral inductors to realise devices such as voltage controlled oscillators (VCOs) in, for example, a transceiver in an integrated circuit (IC).

An inductor can be characterised, inter alia, in terms of its resonant frequency ω, which is a function of the self inductance L of the inductor, and the parasitic capacitance C of the inductor:

$$\omega = \frac{1}{\sqrt{LC}} \tag{1}$$

Another characteristic of an inductor is its Quality factor (Q-factor):

$$Q = \frac{\omega L}{R} \tag{2}$$

where R is the internal resistance of the inductor, and ωL is the inductive resistance of the inductor.

From equation (1), it can be seen that the resonant frequency of an inductor can be increased by minimising the parasitic capacitance. There are two main contributors to the parasitic capacitance of an inductor in an IC: (i) capacitance between the conductive track (which makes up the inductor turns (windings) of the inductor) and the substrate (e.g. semiconductor substrate) on which the inductor is formed, and (ii) capacitance between the inductor turns themselves.

From equation (2), it can be seen that the Q-factor of an inductor is linked to the resonant frequency ω, such that an inductor having a higher resonant frequency also tends to have a higher Q-factor.

FIGS. 1A and 1B schematically illustrate the layout of the windings of a three turn (FIG. 1A) and a four turn (FIG. 1B) inductor. The inductors shown in FIGS. 1A and 1B do not form embodiments of this invention but are instead described herein to provide counter examples of conventional inductor layouts, for comparison with the embodiments described below in relation to FIGS. 3-8.

In FIG. 1A, the inductor 10 includes a conductive track which forms three inductor windings. The conductive track begins at terminal 12 and ends at terminal 14. The inductor 10 shown in FIG. 1A (and also the inductor shown in FIG. 1B) is provided with a centre tap 16 for use in, for example, differential VCO applications. The inductors shown in FIGS. 1A and 1B are substantially symmetrical, in order to allow correct placement of the centre tap 16. In this example, the inductors shown in FIGS. 1A and 1B are also substantially octagonal.

As is shown in FIG. 1A, the inductor includes two crossing points. These crossing points are distributed around the inductor windings such that a first crossing point 24 is provided in the vicinity of the terminals 12 and 14, while the crossing point 22 is provided on an opposite side of the inductor windings, substantially in line with the centre tap 16.

The four turn inductor shown in FIG. 1B has a similar configuration to the three turn inductor shown in FIG. 1A, and includes a first crossing point 24, and second and third crossing points 22 and 23.

The purpose of the crossing points provided in the inductors of FIG. 1A and FIG. 1B is to allow the inductor windings to be formed while enabling the terminals 12 and 14 to connect on the outside of the inductor. Thus, in both FIG. 1A and FIG. 1B, the terminal 12 and the terminal 14 feeds to or feeds from the outermost part of the conductive track, whereby effective connection to the conductive track at the terminals can be made.

The layouts shown in FIGS. 1A and 1B each have associated therewith a given amount of parasitic capacitance that results from capacitance between the various windings of the inductor. FIG. 2 shows a model by which the total parasitic capacitance for an inductor resulting from parasitic capacitance between the inductor turns can be calculated.

An inductor having a voltage V applied across its terminals, and having a number of turns n, has a total parasitic capacitance which can be approximated by:

$$C_{eff} = \sum_i \frac{1}{2} V_i^2 C_i \tag{3}$$

where $V_i$ is the average voltage between the $i^{th}$ pair of adjacent inductor turns, and $C_i$ is the intrinsic capacitance between the $i^{th}$ pair of adjacent inductor turns. Thus, to a first order of approximation (ignoring contributions from non-adjacent portions of the conductive track), an inductor having i adjacent inductor turns has a total parasitic capacitance which is the sum of the parasitic capacitance between all of the adjacent pairs of inductor turns in the inductor.

Turning again to FIGS. 1A and 1B, and assuming that there is a substantially linear voltage drop along the conductive track between the terminal 12 and the terminal 14 of the inductor 10, it can now be seen that according to equation 3, the arrangement of the turns in the inductor 10 has a direct effect upon the overall parasitic capacitance of the inductor. This is because, according to equation 3, the contribution to the total parasitic capacitance arising from a given pair of adjacent inductor turns depends upon the voltage difference between those two adjacent inductor turns, and because the voltage difference between adjacent inductor turns depends directly upon the way in which the inductor turns are laid out.

Therefore, according to the invention, it has for the first time been realised that by designing an inductor layout (e.g. a substantially symmetrical inductor layout) in which the adjacent inductor turns on the whole have a relatively low potential difference there between, the overall parasitic capacitance of the inductor can be reduced, and the resonant frequency and Q-factor of the inductor can thereby be increased.

SUMMARY OF THE INVENTION

Aspects of the invention are set out in the accompanying independent and dependent claims. Combinations of features from the dependent claims may be combined with features of the independent claims as appropriate and not merely as explicitly set out in the claims.

According to an aspect of the invention, there is provided an inductor comprising:

a conductive track forming at least three inductor turns, the conductive track comprising a plurality of track sections; and at least two groups of crossing points, each crossing point comprising a location at which the conductive track crosses over itself, wherein the crossing points of each group collectively reverse the order of at least some of the track sections in the inductor, such that inner track sections of the conductive track cross over to become respective outer track sections, and such that outer track sections of the conductive track cross over to become respective inner track sections.

The claimed invention allows an inductor to be provided, which has reduced parasitic capacitance between the inductor turns thereof, without substantially affecting the inductors self inductance (the self inductance of the inductor is substantially independent of the configuration of the crossing points therein). The reduction in parasitic capacitance is a consequence of the novel arrangement of the track sections, which make up the inductor turns. In particular, the crossing over of the track sections at the group of crossing points causes adjacent track sections in the inductor to have a lower potential difference between them (assuming there is a voltage drop along the length of the conductive track), which in turn leads to a lower effective capacitance between adjacent track sections. Summed over all adjacent track sections in the inductor, the parasitic capacitance is lower than for known inductors. The reduction in parasitic capacitance can lead to an increase in resonant frequency and Q-factor.

In some embodiments, the inductor can be substantially symmetrical, thereby to allow the inclusion of a centre tap (e.g. for differential VCO applications). In theory, the ideal shape for the inductor turns is circular. However, semiconductor manufacturing techniques do not generally allow for features having curves, and instead straight lines must be used. Consequently, in some embodiments, an octagonal shape, which approximates a circle, and which is in conformance with semiconductor manufacture design rules, may be used.

In one embodiment, the crossing points of a first group collectively reverse the order of each track section in the inductor. A second group of crossing points in the inductor can collectively reverse the order of each track section in the inductor, except for the outermost track sections.

In accordance with an embodiment of the invention, the crossing points of at least one group of crossing points can be located together in a common portion of the inductor. This collocation of the crossing points ensures that overlap between adjacent track sections in the inductor having reduced potential difference there-between is maximised, whereby the benefit of reducing the parasitic capacitance between adjacent track sections is also maximised. If the crossing points were distributed throughout the inductor, at least some adjacent track sections would have a higher potential difference there-between, and consequently the overall parasitic capacitance between the turns in the inductor would be increased.

The inductor can have n turns. According to one embodiment, the number of crossing points in the inductor N can be given by $N=(n-1)^2$. Thus, a three turn inductor can have four crossing points, a four turn inductor can have nine crossing points, and a five turn inductor can have sixteen crossing points.

The inner diameter of an inductor in accordance with an embodiment of this invention can be selected to achieve quality factors which exceed those of known inductors. For example, a five turn inductor of the kind described herein can have an inner diameter $d_{in} \geqq 100$ μm, a four turn inductor of the kind described herein can have an inner diameter $d_{in} \geqq 85$ μm, and a three turn inductor of the kind described herein can have an inner diameter $d_{in} \geqq 75$ μm.

In one embodiment, each crossing point can include insulation for electrically isolating the conductive track, to prevent electrical shorting between the track sections.

The inductor turns can be arranged in a common plane. As such, the inductor can take on a substantially 2-D configuration, notwithstanding the fact that the crossing points may involve the conductive track briefly venturing "out of plane".

In one embodiment, the turns of the inductor can have a regular shape (e.g. circular, or in the shape of a polygon). In one example, the inductor turns are substantially octagonal.

According to another aspect of the invention, there is provided a transceiver comprising an inductor of the kind described above.

According to a further aspect of the invention, there is provided an integrated circuit comprising an inductor of the kind described above.

BRIEF DESCRIPTION OF THE DRAWINGS

Embodiments of the present invention will be described hereinafter, by way of example only, with reference to the accompanying drawings in which like reference signs relate to like elements and in which.

DETAILED DESCRIPTION OF EMBODIMENTS

Embodiments of the present invention are described in the following with reference to the accompanying drawings.

Figure 3:
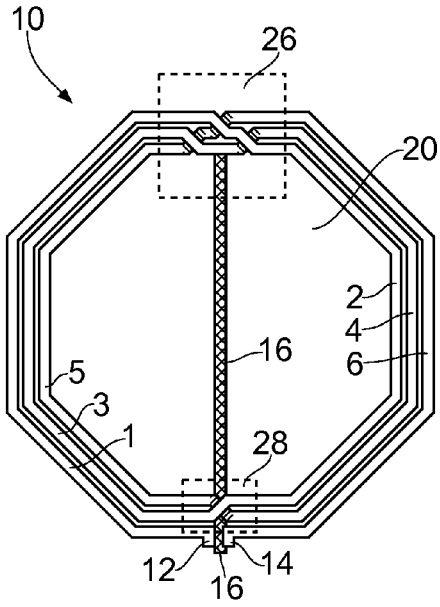
FIG. 3 shows a three turn inductor according to an embodiment of the invention.

A first embodiment of the invention is illustrated in FIG. 3. In this embodiment, there is provided a three turn inductor 10. The inductor 10 includes a conductive track which extends between conductor terminals 12 and 14 to form the three windings. In this example, the inductor is substantially symmetrical and substantially octagonal, although these features are not essential to the invention. For example, the inductor may not be exactly symmetrical, and shapes other than an octagon may be employed (e.g. square, hexagonal). Nevertheless, the substantially symmetrical configuration of the windings of the inductor allow the appropriate inclusion of a centre tap 16 as shown in FIG. 3. Moreover, the octagonal configuration of the inductor complies with known design rules for semiconductor manufacturing processes.

In this example, the inductor 10 includes six track sections (1, 2, 3, 4, 5, 6). Each track section comprises a portion of the conductive track which extends between a first group 26 of crossing points and a second group 28 of crossing points. In this example, each track section (1, 2, 3, 4, 5, 6) corresponds to roughly one half turn of the conductive track.

The crossing points of the first group 26 collectively reverse the order of the track sections in the inductor, such that inner track sections of the conductive track cross over to become respective outer track sections, and such that outer track sections of the conductive track cross over to become respective inner track sections. Thus, with reference to FIG. 3, track section 1, which leads from the terminal 12 of the inductor 10, is an outermost track section. However, at the group 26 of crossing points, this track section crosses over to become track section 2, which is an innermost track section. Similarly, track section 5, which is an innermost track section in the inductor 10 crosses over at the group 26 of crossing points to become track section 6, which is an outermost track section.

In this example, the inductor 10 also includes a second group of crossing points 28. In fact, for a three turn inductor, the second group 28 of crossing points includes only a single crossing point. The second group 28 is arranged substantially opposite the first group 26 of crossing points, to maintain symmetry in the inductor. This has the effect, in this example, of placing the second group 28 in the vicinity of the terminals 12 and 14.

At the second group 28 of crossing points, the order of at least a subset of the track sections in the inductor 10 is again reversed. In particular, in this example, the order of all of the track sections in the inductor 10 except for the outermost track sections is reversed. Thus, at the group 28 of crossing points, track sections 2 and 4 switch positions, to become track sections 3 and 5. The track section 2, which is an inner track section, crosses over to become an outer track section, (notwithstanding the presence of track section 1, which is an innermost track section, the order of which is not affected by the group 28 of crossing points). Similarly, the track section 4, which crosses over to become an inner track section 5 (notwithstanding the presence of track section 6, which is an outermost track section, not affected by the group 28 of crossing points).

The effect of the reversal of the order of track sections will now be described.

As noted above, the six track sections in FIG. 3 have been labelled 1-6. Since the track section labelling also corresponds to the order in which those track sections appear in the conductive track that forms the inductor windings, it can also be assumed that the voltage within the track section corresponds (approximately inversely) to the track section label. Thus, for example, track section 1, which feeds directly from the terminals 12 has (to a first approximation) the highest voltage associated therewith, while track section 2 has a slightly lower voltage (owing to the voltage drop across the first track section 1), and so on until the track section 6, which feeds into the terminal 14, and which has the lowest voltage.

From FIG. 3, it can be seen that the effect of the groups 26 and 28 of crossing points is to place the track sections in an order in which adjacent track sections have a minimal voltage difference there between. Thus, for example, track section 1 is adjacent track section 3. This can be compared with the example of FIG. 1A, where the first track section leading from the terminal 12 is adjacent a track section which is far further along the conductive track, whereby the voltage difference between the first track section in FIG. 1 and its adjacent track section is larger than the voltage difference between the track sections 1 and 3 shown in FIG. 3. By comparing the various track sections in FIG. 3 and their adjacent track sections with the track sections and adjacent track sections of FIG. 1A, it can be seen that the overall total parasitic capacitance of the inductor shown in FIG. 3 (arising from capacitance between adjacent track sections) is smaller. This lower parasitic capacitance results from the generally lower voltages between the adjacent track sections in FIG. 3, resulting in smaller contributions to the summation of equation 3.

Figure 4:
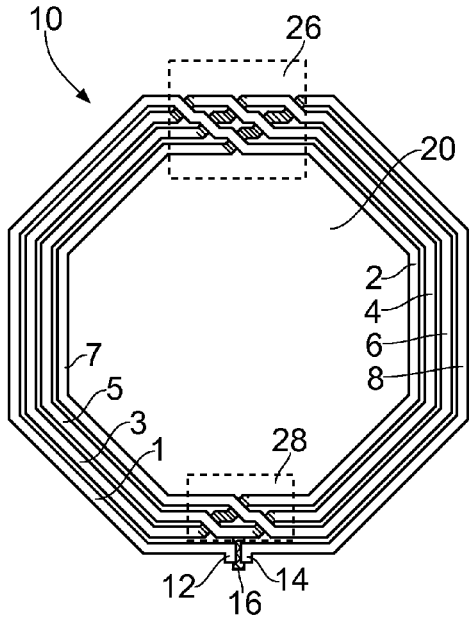
FIG. 4 shows a four turn inductor according to an embodiment of the invention.

The principal of providing a group of crossing points to reverse the order of the track sections in the inductor can be applied to inductors having any number (n) of inductor turns, where n is at least 3. Thus, for example, FIG. 4 illustrates a second embodiment of the invention, in which there is provided an inductor 10 having n=4 inductor turns. The inductor 10 in FIG. 4 includes similar features to those described above in relation to FIG. 3 (terminals 12 and 14, a centre tap 16, a first group 26 of crossing points and a second group 28 of crossing points). As the inductor 10 in FIG. 4 has four windings, eight track sections (1, 2, 3, 4, 5, 6, 7, 8) are present.

As with FIG. 3, at the first group 26 of crossing points, the order of the track sections in the inductor is reversed such that inner track sections of the conductive track cross-over to become respective outer track sections, and such that outer track sections of the conductive track cross-over to become respective inner track sections. Thus, for example, and as shown by FIG. 4, at the group 26 of crossing points, track section 1, which is an outermost track section, crosses over to become track section 2 which is an innermost track section. Meanwhile, track section 7, which is an innermost track section, crosses over to become track section 8, which is an outermost track section.

In FIG. 3, the position of the middle track section, which is neither an inner nor an outer respective track section is unaffected by the group 26 of crossing points. However, in the example of FIG. 4, which has an even number of inductor turns, there is no middle track section. Thus, at the group 26 of crossing points, the track section 3, which is an outer track section crosses over to become track section 4, which is a respective inner track section, while track section 5, which is an inner track section, crosses over to become track section 6, which is a respective outer track section. Thus, at the group 26 of crossing points, outer track sections become respective inner track sections, and inner track sections become respective outer track sections.

In common with the example described above in relation to FIG. 3, the inductor 10 in FIG. 4 has a second group 28 of crossing points which have the effect of collectively reversing the order of at least a subset of the track sections in the inductor. In particular, in this example, the group 28 of crossing points collectively reverse the order of all of the track sections in the inductor 10, except for the outermost track sections. Thus, the positions of track sections 1 and 8 in FIG. 4 are not affected by the group 28 of crossing points. The remaining track sections (3, 4, 5, 6, 7) have their order reversed, such that outer track sections become respective inner track sections, and inner track sections become respective outer track sections. By comparing FIGS. 3 and 4, it can be seen that the second group 28 of crossing points in FIG. 4 operates similarly to the first group 26 of crossing points in FIG. 3, and indeed it is noted that both groups of crossing points collectively reverse the order of the track sections in three inductor turns.

Following a similar logic to that described above in relation to FIG. 3, it can be seen that the voltage difference between adjacent track sections in the inductor 10 of FIG. 4 is minimised by the provision of the group of crossing points 26 and the group of crossing points 28. Thus, it is envisaged that the overall parasitic capacitance of an inductor of the kind shown in FIG. 4 would be minimised.

As indicated above, the principal of applying groups of crossing points which collectively reverse the order of the track sections in an inductor can be applied to any inductor having n=3 or more inductor turns. Collectively, the groups of crossing points in the inductor would have a total number of crossing points $N=(n-1)^2$. Thus, an inductor having three inductor turns has N=4 crossing points (as can be confirmed by inspection of FIG. 3), an inductor having n=4 inductor turns has N=9 crossing points (as can be confirmed by inspection of FIG. 4), and so on.

Figure 7:
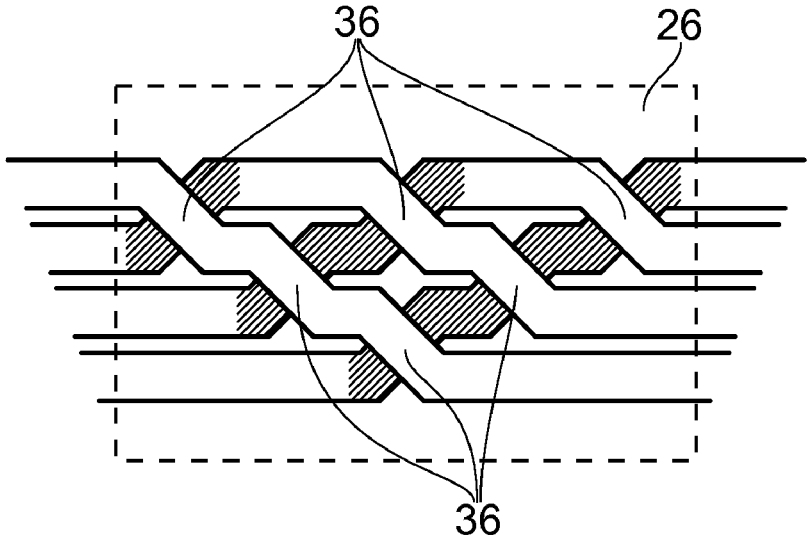
FIG. 7 shows group 16 of crossing points in FIG. 4 in more detail.

FIG. 7 illustrates the group 26 of crossing points 36 in a four turn inductor in more detail. In accordance with an embodiment of the invention, the inductor is substantially planar, such that each of the inductor turns is arranged in a common plane, notwithstanding the fact that in order to cross-over itself, the conductive track may need to venture "out of plane" momentarily. In FIG. 7, it can be seen that the crossing points 36 each are provided with insulator, for preventing electrical shorting between the track sections where they cross-over (this is indicated by the hatched sections in FIG. 7).

In principal, it may be possible to spread the crossing points around the diameter of the inductor turns. However, it is beneficial to group the crossing points 36 together as shown in FIG. 7, since this collocation ensures that the benefit of having adjacent track sections with relatively low voltage differences there between is maximised. Grouping the crossing points 36 together in this way requires some form of configuration and ordering for the crossing points to be determined.

Figure 8:
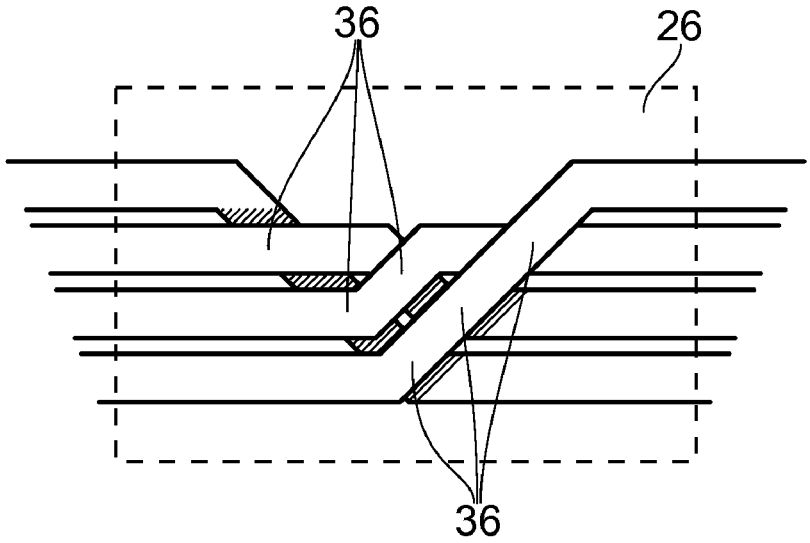
FIG. 8 shows group 16 of crossing points in FIG. 6 in more detail.

FIG. 7 illustrates one example layout for the group of crossing points 36. Another example is illustrated in FIG. 8. The layout shown in FIG. 8 is more compact than the layout shown in FIG. 7. As a consequence, the layout of FIG. 8 is easier to implement for inductors having smaller inner diameters. Additionally, the layout of FIG. 8 has a slightly lower resistance, which is beneficial in terms of Q-factor (see equation 2).

Figure 5:
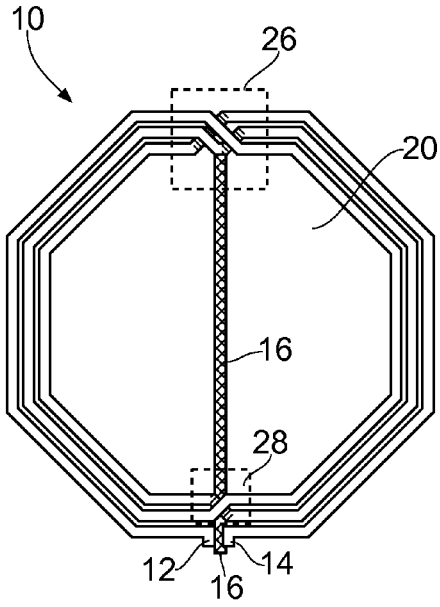
FIG. 5 shows a three turn inductor according to an embodiment of the invention.
Figure 6:
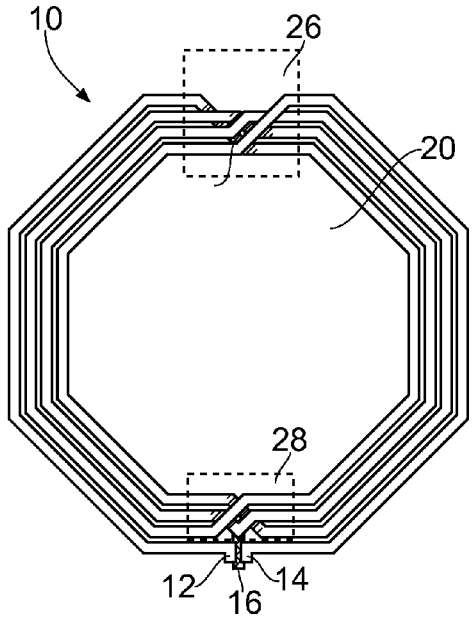
FIG. 6 shows a four turn inductor according to an embodiment of the invention.

FIGS. 5 and 6 show three and four turn (respectively) inductors. These are similar to the inductors described above in relation to FIGS. 3 and 4, except that they employ crossing point configurations of the kind described above in relation to FIG. 8, instead of the crossing point configurations shown in FIG. 7.

FIGS. 9-14 show the results of modelling work that has been performed to simulate and thereby demonstrate the potential improvements which may be afforded by an inductor in accordance with an embodiment of this invention.

Figure 9:
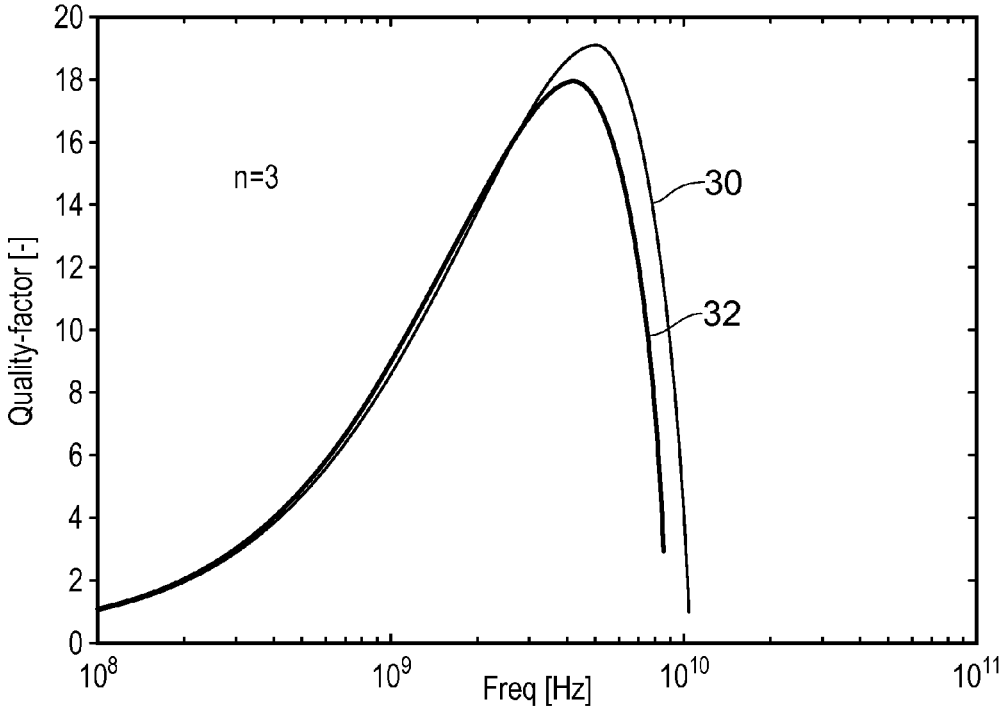
FIG. 9 shows a simulated comparison, of Q-factor as a function of frequency, between a known three turn inductor of the kind shown in FIG. 1A, and an inductor according to the embodiment of the invention as shown in FIG. 3.
Figure 10:
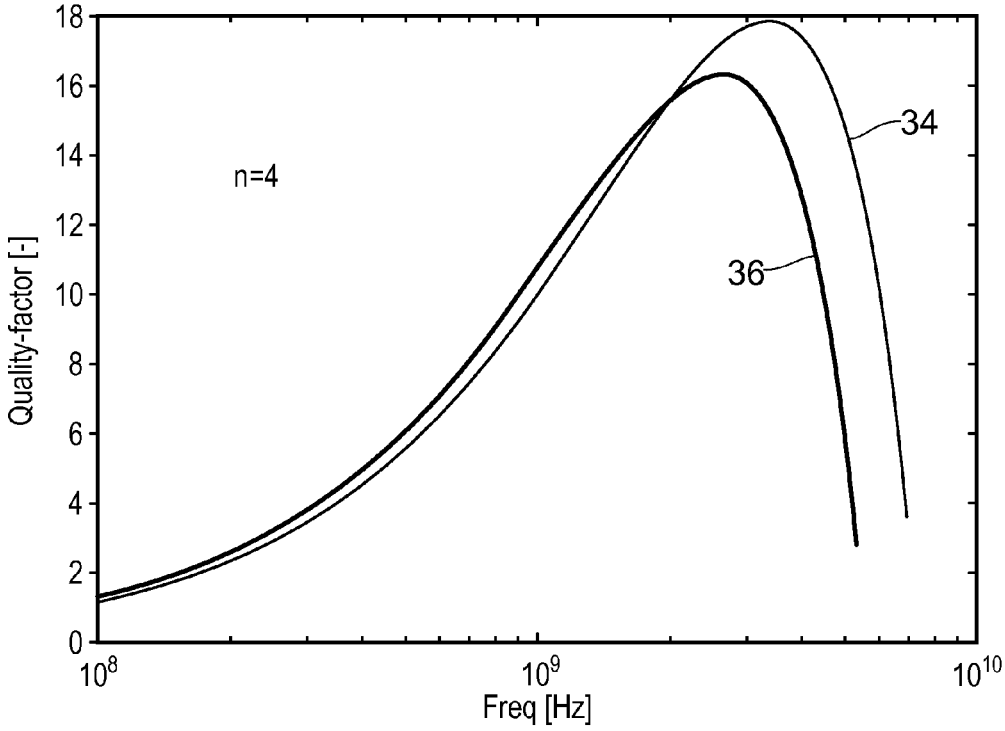
FIG. 10 shows a simulated comparison, of Q-factor as a function of frequency, between a known four turn inductor of the kind shown in FIG. 1B, and an inductor according to the embodiment of the invention as shown in FIG. 4.
Figure 11:
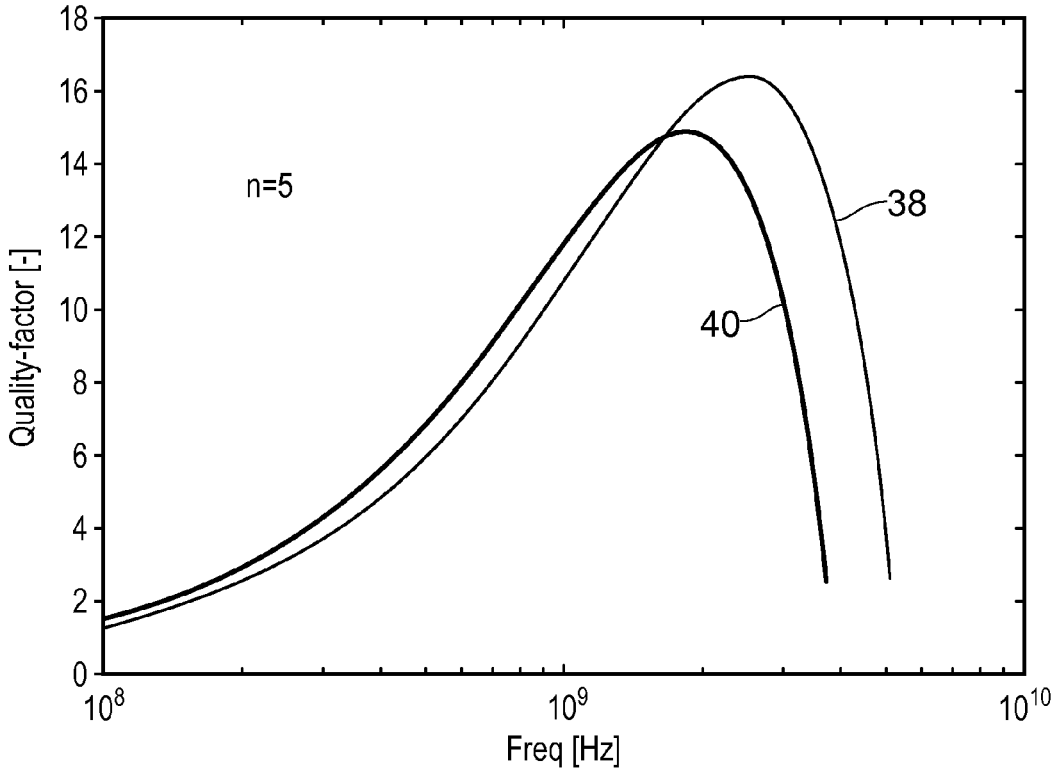
FIG. 11 shows a simulated comparison, of Q-factor as a function of frequency, between a known five turn inductor, and five turn inductor according to the embodiment of the invention.

FIGS. 9-11 show plots of Q-factor as a function of frequency for an inductor having n=3 inductor turns (FIG. 9), n=4 inductor turns (FIG. 10), and n=5 inductor turns (FIG. 11). In FIG. 9, the line 30 indicates the theoretical Q-factor as a function of frequency of an inductor of the kind shown in FIG. 3, while the line 32 shows the Q-factor of an inductor of the kind shown in FIG. 1A. In FIG. 10, the line 34 illustrates the Q-factor as a function of frequency of an inductor of the kind shown in FIG. 4 as compared with the line 36, which shows the Q-factor as a function of frequency of an inductor of the kind shown in FIG. 1B. In FIG. 11, this comparison is extended to an inductor having n=5 turns (a line 38 shows the Q-factor of an inductor in accordance with an embodiment of the invention, while the line 40 shows a conventional inductor having five turns and a configuration similar to that described above in relation to FIGS. 1A and 1B).

By inspecting FIGS. 9-11, it can be seen that in all cases, the peak Q-factor of the inductor in accordance with an embodiment of the invention is higher than the peak Q-factor of the conventional inductor. Additionally, inductors in accordance with an embodiment of this invention have a peak Q-factor which occurs at a resonant frequency which is higher as compared to that of known inductors.

Nevertheless, it can also be seen that for lower frequencies, the Q-factor of the conventional inductors is slightly higher than the Q-factor of the inductor in accordance with an embodiment of this invention. This is because the resistance in the conductive track forming the inductor in accordance with an embodiment of the invention is slightly higher than the conductive track of the conventional inductors of the kind shown in FIGS. 1A and 1B. This higher resistance results from the fact that each crossing point in the inductor slightly increases the resistance of the conductive track, and more crossing points are required to construct an inductor in accordance with an embodiment of the invention than are required to construct conventional inductors of the kind shown in FIGS. 1A and 1B.

Above, it has been stated that the peak Q-factor in FIGS. 9-11 for inductors according to an embodiment of this invention is generally higher. However, in some examples, this may depend upon the dimensions of the inductor. In fact, the advantages of the layout proposed in this application, as opposed to the disadvantages thereof (reduced voltage difference between adjacent track sections versus the need for a greater number of crossing points incurring higher resistivity) are balanced against each other, as a function of the overall length of the conductive track forming the inductor windings.

The length of the conductive track corresponds generally to the inner diameter of the innermost pair of track sections. Thus, for an inductor having a larger inner diameter, the longer length of the conductive track forming the inductor windings means that the benefits of the adjacent track sections in the inductor having lower voltages there between is more pronounced. However, for inductors having a smaller inner diameter, the disadvantageous increase in resistance caused by the increased number of crossing points in the inductor becomes more pronounced.

Figure 1A:
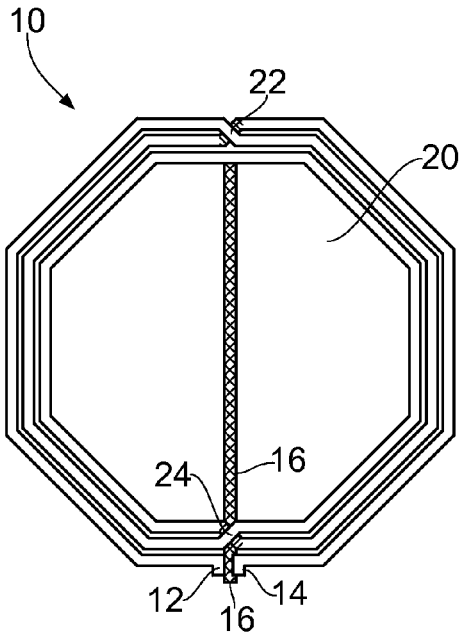
FIG. 1A schematically illustrates the windings of a known three turn inductor.
Figure 1B:
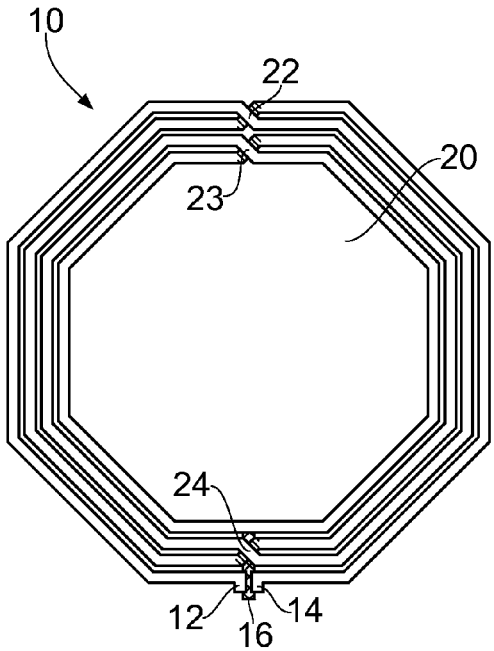
FIG. 1B schematically illustrates the windings of a known four turn inductor.
Figure 2:
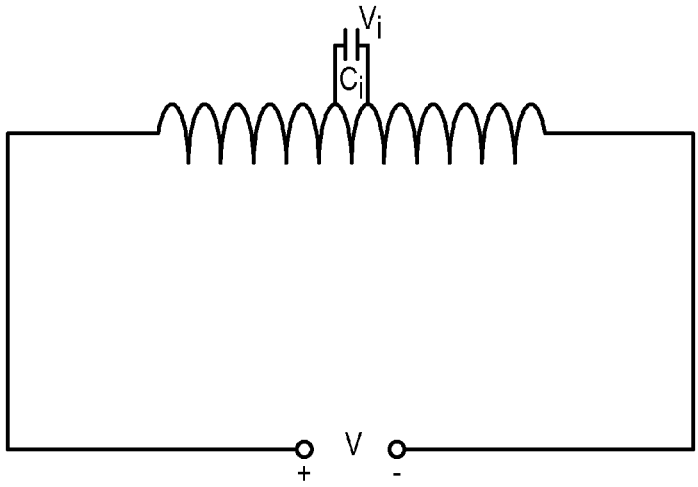
FIG. 2 illustrates that the overall parasitic capacitance (between turns) in an inductor can be calculated as the sum of effective capacitances between adjacent turns in the inductor.
Figure 12:
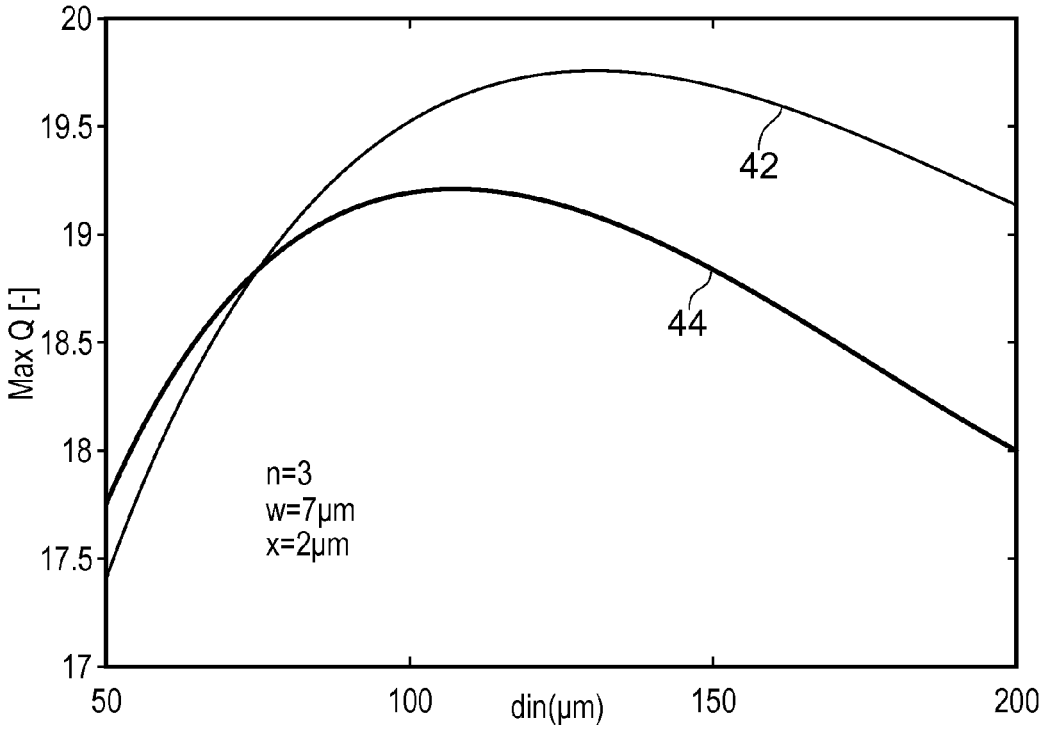
FIG. 12 shows a simulated comparison, of maximum Q-factor as a function of the inner diameter $d_{in}$, between a known three turn inductor of the kind shown in FIG. 1A, and an inductor according to the embodiment of the invention as shown in FIG. 3.
Figure 13:
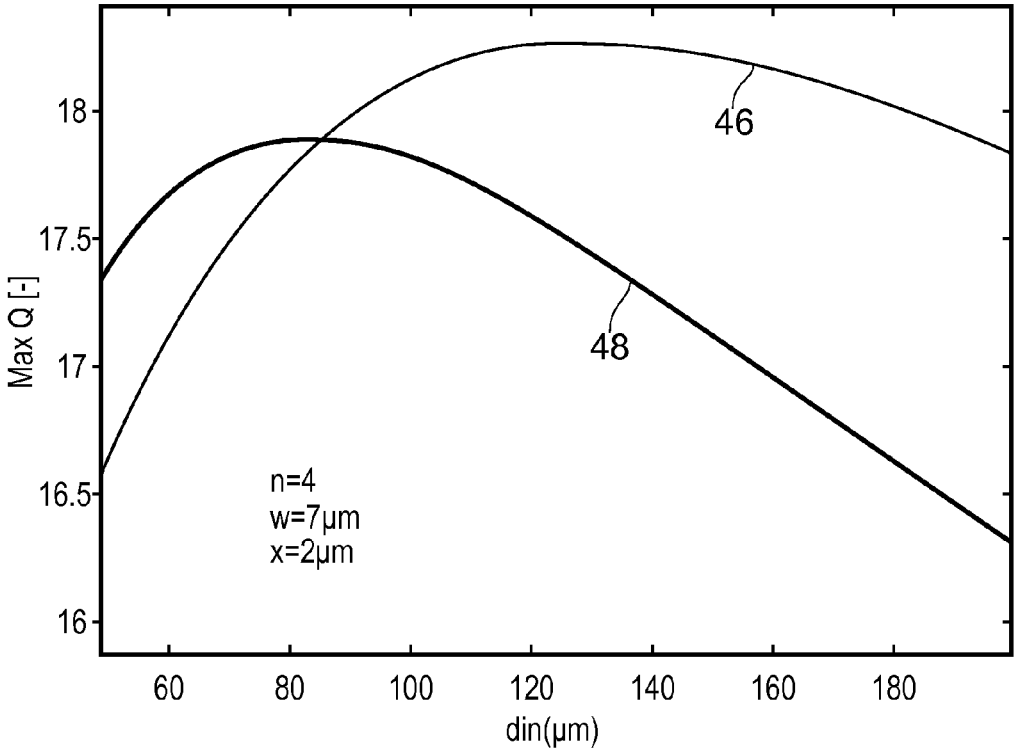
FIG. 13 shows a simulated comparison, of maximum Q-factor as a function of the inner diameter $d_{in}$, between a known four turn inductor of the kind shown in FIG. 1B, and an inductor according to the embodiment of the invention as shown in FIG. 4.
Figure 14:
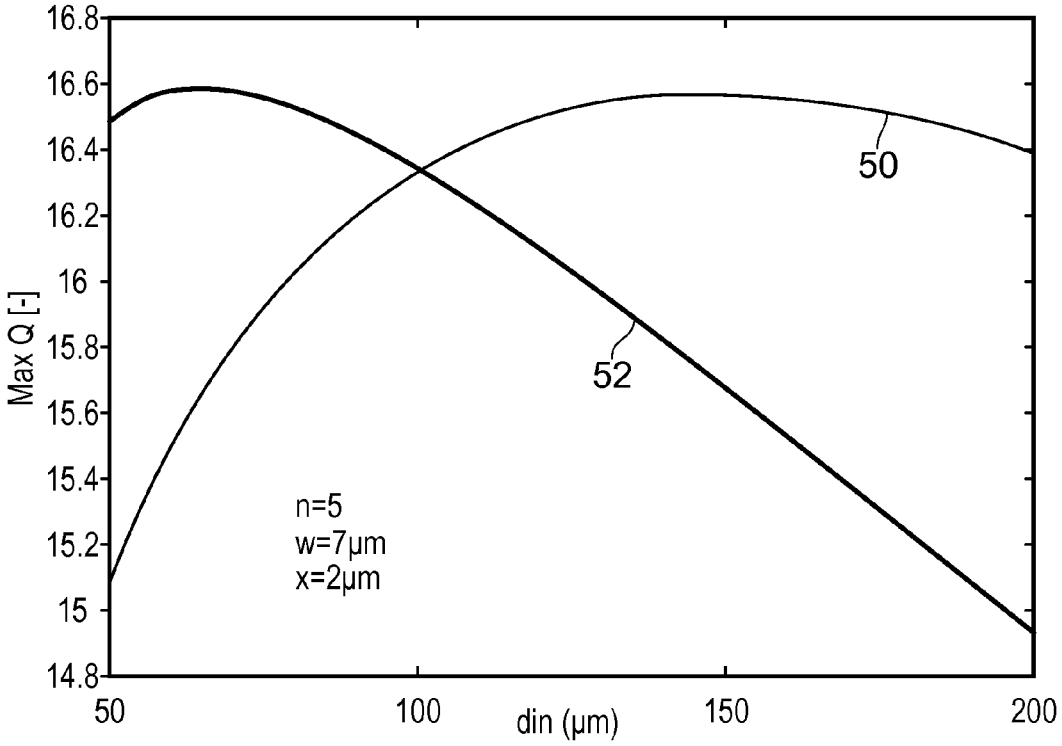
FIG. 14 shows a simulated comparison, of maximum Q-factor as a function of the inner diameter $d_{in}$, between a known five turn inductor, and five turn inductor according to the embodiment of the invention.

This balance is demonstrated in FIGS. 12-14, which each plot the peak Q-factor of an inductor in accordance with an embodiment of this invention (lines 42, 46 and 50) as a function of inner diameter of the inductor, compared with inductors of the kinds shown in FIGS. 1A and 1B (lines 44, 48 and 52). This comparison is formed for an inductor having n=3 turns (FIG. 12), an inductor having n=4 turns (FIG. 13), and an inductor having n=5 turns (FIG. 14).

In each case, it can be seen that for lower inner diameters, the conventional inductor achieves a higher peak Q-factor (max-Q) but that as the inner diameter of the inductors is increased, the benefits of having adjacent track sections with lower voltages there between comes dominant. In each of the simulations shown in FIGS. 12-14, the conductive track forming the inductor turns has a width of 7 μm, and the spacing between each conductive track was assumed to be 2 μm. Similar results can be achieved for inductors having different track widths and spacings.

In FIG. 12 it can be seen that the maximum Q-factor of an inductor in accordance with an embodiment of this invention (with n=3) is higher for inductors having an inner diameter of at least 75 μm. From FIG. 13 it can be seen that an inductor in accordance with an embodiment of this invention (with n=4) has a higher Q-factor for inner diameters of at least 85 μm. From FIG. 14, it can be seen that an inductor (with n=5) in accordance with an embodiment of the invention has a higher max Q-factor for inner diameters of at least 100 μm.

This invention can be applied to inductors used in a wide variety of applications. Moreover, since the invention relates to the geometry and layout of the inductor windings, the invention can be generally applied to any inductor having three or more inductor turns. The inductor may be an inductor of the kind that is incorporated in an integrated circuit, and may thus be used in differential VCO applications in a transceiver.

Accordingly, there has been described an inductor includes a conductive track forming at least three inductor turns. The conductive track has a plurality of track sections. The inductor also includes a group of crossing points. Each crossing point corresponds to a location at which the conductive track crosses over itself. The crossing points of the group collectively reverse the order of the track sections in the inductor, such that inner track sections of the conductive track cross over to become respective outer track sections, and such that outer track sections of the conductive track cross over to become respective inner track sections.

Although particular embodiments of the invention have been described, it will be appreciated that many modifications/additions and/or substitutions may be made within the scope of the claimed invention.

The invention claimed is:

1. An inductor comprising:

a conductive track forming at least three inductor turns, the conductive track including a plurality of track sections; and at least two groups of crossing points, each crossing point having a location at which the conductive track crosses over itself, wherein the crossing points of each group collectively reverse an order of an innermost one and an outermost one of the track sections in the inductor, such that the innermost track section of the conductive track crosses over to become the outermost track section, and such that the outermost track section of the conductive track crosses over to become the innermost track section.

2. An inductor comprising:

a conductive track forming at least three inductor turns, the conductive track including a plurality of track sections; and at least two groups of crossing points, each crossing point having a location at which the conductive track crosses over itself, wherein the crossing points of each group collectively reverse an order of at least some of the track sections in the inductor, such that inner track sections of the conductive track cross over to become respective outer track sections, and such that outer track sections of the conductive track cross over to become respective inner track sections;

wherein the crossing points of a first group collectively reverse the order of each track section in the inductor.

3. The inductor of claim 2, wherein the crossing points of a second group collectively reverse the order of each track section in the inductor, except for the outermost track sections.

4. The inductor of claim 1, wherein the crossing points of at least one of the groups of crossing points are located together in a common portion of the inductor.

5. An inductor comprising:

a conductive track forming n inductor turns connected in series, wherein n≧2, the conductive track including a plurality of track sections; and N crossing points, wherein $N=(n-1)^2$, the N crossing points including at least two groups of crossing points, each crossing point having a location at which the conductive track crosses over itself, wherein the crossing points of each group collectively reverse an order of at least some of the track sections in the inductor, such that inner track sections of the conductive track cross over to become respective outer track sections, and such that outer track sections of the conductive track cross over to become respective inner track sections.

6. The inductor of claim 5, wherein n=3 and N=4, n=4 and N=9 or n=5 and N=16.

7. The inductor of claim 6, having an inner diameter $d_{in}$≧100 μm, and wherein n=5.

8. The inductor of claim 6, having an inner diameter $d_{in}$≧85 μm, and wherein n=4.

9. The inductor of claim 6, having an inner diameter $d_{in}$≧75 μm, and wherein n=3.

10. The inductor of claim 1, wherein each crossing point comprises insulation for electrically isolating the conductive track, to prevent electrical shorting between the track sections.

11. The inductor of claim 1, wherein the inductor turns are arranged in a common plane.

12. The inductor of claim 1, wherein the inductor turns are substantially symmetrical.

13. The inductor of claim 1, wherein the inductor turns are substantially octagonal.

14. A transceiver comprising the inductor of claim 1.

15. An integrated circuit comprising the inductor of claim 1.

16. The inductor of claim 5, wherein each of the n inductor turns forms a respective loop of the conductive track.

* * * * *